US006481983B1

(12) United States Patent
Miller

(10) Patent No.: US 6,481,983 B1
(45) Date of Patent: Nov. 19, 2002

(54) HANDLESS OR FOOTLESS OPERATION OF AN ELECTRICAL AUTOMATIC WATER FLOW CONTROL APPARATUS

(76) Inventor: Gerald W. Miller, 23657 Emelita St. No. 100, Woodland Hills, CA (US) 91367

( * ) Notice: Subject to any disclaimer, the term of this patent is extended or adjusted under 35 U.S.C. 154(b) by 0 days.

(21) Appl. No.: 09/882,929

(22) Filed: Jun. 14, 2001

Related U.S. Application Data

(62) Division of application No. 09/579,703, filed on May 26, 2000.

(51) Int. Cl.[7] ..... F04B 17/00

(52) U.S. Cl. ..... 417/411; 251/129.04; 251/291; 251/295; 4/619

(58) Field of Search ..... 251/295, 294, 251/129.02, 129.04, 291; 4/619, 630, 624; 137/607; 417/411

(56) References Cited

U.S. PATENT DOCUMENTS

| | | | | |
|---|---|---|---|---|
| 1,836,766 A | | 12/1931 | Mullett et al. | |
| 4,295,609 A | * | 10/1981 | Brown, Jr. | 239/29 |
| 4,429,422 A | | 2/1984 | Wareham | |
| 4,835,814 A | * | 6/1989 | Bonnet | 15/339 |
| 5,033,508 A | | 7/1991 | Laverty, Jr. | |
| 5,039,973 A | * | 8/1991 | Carballo | |
| 5,043,594 A | * | 8/1991 | Carballo | 307/31 |
| 5,322,086 A | * | 6/1994 | Sullivan | 251/129.04 |
| 5,485,869 A | | 1/1996 | Haynes | |
| 5,595,216 A | | 1/1997 | Pilolla | |
| 5,755,262 A | | 5/1998 | Pilolla | |
| 5,893,387 A | | 4/1999 | Paterson et al. | |
| 5,941,504 A | * | 8/1999 | Toma et al. | 251/295 |
| 6,298,872 B1 | * | 10/2001 | Keller | 137/360 |

FOREIGN PATENT DOCUMENTS

| | | |
|---|---|---|
| JP | 6113967 | 4/1994 |
| JP | 10140633 | 5/1998 |

* cited by examiner

*Primary Examiner*—Cheryl J. Tyler
(74) *Attorney, Agent, or Firm*—Thomas I. Rozsa; Tony D. Chen

(57) ABSTRACT

A handless or footless operation of an electrical automatic water flow control apparatus for turning water on and off without touching the faucet lever of a faucet. The electrical water flow control apparatus is installed in line between the water shutoff valves from the wall and the water supply lines that descend from a faucet. The flow control apparatus includes a housing which houses a pair of solenoid operated valves. Each solenoid operated valve has an inlet port and an outlet port, where the ports are protruding through a wall of the housing. The inlet ports are connected to the hot and cold water shutoff valves by flexible hoses. The outlet ports are connected to the water supply lines from the faucet by flexible hoses. The electrical flow control apparatus further comprises an elongated bar switch actuator and a transformer which supplies power to the solenoid operated valves. The bar switch actuator is constructed of microswitches which are electrically connected together and to the solenoid operated valves. The solenoid operated valves are operated by depressing any part of the elongated bar switch actuator with any part of body of a user, which when depressed energizes the solenoid operated valves to open to allow the flow of water therethrough and when the elongated bar switch actuator is not depressed, closes the solenoid operated valves to stop the flow of water through the flow control apparatus.

9 Claims, 6 Drawing Sheets

HANDLESS OR FOOTLESS OPERATION OF AN ELECTRICAL AUTOMATIC WATER FLOW CONTROL APPARATUS

This application is a division of Ser. No. 09/579,703 filed May 26, 2000.

BACKGROUND OF THE INVENTION

1. Field of the Invention

The present invention generally relates to the field of faucets. More particularly, the present invention relates to the field of handless or footless operation of electrical water flow control devices to conserve water and energy, reduce the waste of water, and also to eliminate the waste of water.

2. Description of the Prior Art

Specifically, prior art water flow control devices are well known in the art. These prior art water flow control devices are mechanically operated and utilize a foot pedal to operate the valves to start and stop the flow of water through the flow control device without touching the faucet lever of a faucet. One of the disadvantages of using a foot pedal with the flow control device is that the foot pedal gets in the way of a person cleaning the floor because the foot pedal is normally located on the floor. Another disadvantage is that since the foot pedal is at the floor level, it can cause injury to someone tripping on the foot pedal.

The following nine (9) prior art patents are found to be pertinent to the field of the present invention:

1. U.S. Pat. No. 1,836,766 issued to Mullett et al. on Dec. 15, 1931 for "Foot Controlled Wash Fountain" (hereafter the "Mullett Patent");
2. U.S. Pat. No. 4,429,422 issued to Wareham on Feb. 7, 1984 for "Flow Control Device" (hereafter the "Wareham Patent");
3. U.S. Pat. No. 5,033,508 issued to Laverty, Jr. on Jul. 23, 1991 for "Sensor Operated Water Flow Control" (hereafter the "Laverty Patent");
4. U.S. Pat. No. 5,485,869 issued to Haynes on Jan. 23, 1996 for "Hydraulic Dual Solenoid Directional Control Valve With Manual Override Lock-Out Linkage" (hereafter the "Haynes Patent");
5. U.S. Pat. No. 5,595,216 issued to Pilolla on Jan. 21, 1997 for "Sink Arrangement With Faucet Having Dual Operational Mode" (hereafter "the '216 Pilolla Patent");
6. U.S. Pat. No. 5,755,262 issued to Pilolla on May 26, 1998 for "Electrically Actuatable Faucet Having Manual Temperature" (hereafter "the '262 Pilolla Patent");
7. U.S. Pat. No. 5,893,387 issued to Paterson et al. on Apr. 13, 1999 for "Gasketing And Bleed Means For An Electrically Controlled Faucet Assembly" (hereafter the "Paterson Patent");
8. Japanese Patent No. 6,113,967 issued to Keiko (hereafter the "Keiko Patent"); and
9. Japanese Patent No. 10,140,633 issued to Yasuhito (hereafter the "Yasuhito Patent").

The Mullett Patent discloses a foot controlled wash fountain.

The Wareham Patent discloses a flow control device for delivering either cold water or hot water mixed with cold water. It includes a chamber for mixing hot water with cold water and a pair of solenoid operated valves which stops and starts the flow of hot and cold water through the chamber.

The Laverty Patent discloses a sensor operated water flow control. It comprises an infrared pulsed sensor which controls a solenoid valve to provide the flow of water and cutoff water flow in the water line going to the faucet head. Sensor means is provided for controlling the flow of water.

The Hayes Patent discloses a hydraulic dual solenoid directional control valve with a manual override lock-out linkage. The hydraulic dual solenoid directional control valve controls a faucet through a rod to actuate solenoid valves. When the rod is moved in one direction, the sleeve and rod are moved such that an interference fit is provided with rotation between the sleeve and the projection on one hinge causing the lever to yieldingly apply force to the pin of the corresponding solenoid, actuating the valve in one direction. The Hayes Patent is basically a mechanical actuation of the valves.

The '216 Pilolla Patent discloses a sink arrangement with a faucet having a dual operational mode.

The '262 Pilolla Patent discloses an electrically actuatable faucet having a manual temperature control.

The Paterson Patent discloses a gasketing and bleed means for an electrically controlled faucet assembly. The faucet assembly is operated by pushing a button or placing hands within the operating range of a sensor.

The Keiko Patent discloses a hand washing sink system for electrically controlling the shampoo agent for shampoo, rinse, etc., air blow, and the supply of hot-water/cold-water in lump and feeding each material from one discharge port.

The Yasuhito Patent discloses a foot-operated automatic water feed/stop device. It includes a foot switch that has been interlocked with a solenoid valve for opening or closing the flow passage to the faucet. The Yasuhito Patent is basically a mechanical device.

It is highly desirable to have a very efficient and also very effective design and construction of an electrical hands-free automatic water flow control apparatus for conserving water and energy, and eliminating of water waste while performing normal daily duties at the sink or any other such place where water may be lost due to an open faucet while performing a normal or unusual chore, including the use of water from a faucet left on accidentally or protecting against bacteria spreading with certain kinds of food. The flow control apparatus stops unnecessary water loss through normal or unusual chores done at the sink or any other place reducing the total water consumption.

SUMMARY OF THE INVENTION

The present invention is a novel and unique handless or footless operation of the present invention electrically operated automatic water flow control apparatus for turning water on and off without touching the faucet lever of a faucet. With the electrical flow control apparatus, a user sets the default temperature from a faucet lever, so that the user doesn't waste water when adjusting the faucet.

The electrical water flow control apparatus is installed in line between the water shutoff valves from the wall and the water supply lines that descend from a faucet. The water flow control apparatus includes a housing which houses a pair of solenoid operated valves. Each solenoid operated valve has an inlet port and an outlet port, where both of the ports are protruding through a wall of the housing. The inlet ports are connected to the hot and cold water shutoff valves by flexible hoses with compression nuts on each end. The outlet ports are connected to the water supply lines from the faucet by flexible hoses.

The electrical flow control apparatus further comprises an elongated bar switch actuator and a transformer which supplies power to the solenoid operated valves by reducing 110V AC power to 24V power. The bar switch actuator is constructed of micro-switches which are electrically connected together and to the solenoid operated valves. The solenoid operated valves are operated by depressing any part of the elongated bar switch actuator with any part of a user's body which when depressed, energizes the solenoid operated valves to open to allow the flow of water therethrough and when the elongated bar switch actuator is not depressed, closes the solenoid operated valves to stop the flow of water through the flow control apparatus.

It is an object of the present invention to provide an electrical hands-free automatic water flow control apparatus for conserving water and energy, and eliminating the waste of water while performing normal daily duties at the sink or any other such place where water may be lost due to an open faucet.

It is an additional object of the present invention to provide an electrical hands-free automatic water flow control apparatus which includes solenoid operated valves which stop and start the flow of water through the flow control apparatus.

It is a further object of the present invention to provide an electrical hands-free automatic water flow control apparatus which includes an elongated bar switch actuator so that the apparatus can be activated by any body part of a person using the water flow control apparatus without use of the person's hands or feet.

In the preferred embodiment of the present invention, the electrical hands-free automatic water flow control apparatus is powered by AC power.

In an alternative embodiment of the present invention, the electrical hands-free automatic water flow control apparatus is powered by a 12V battery.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

For clarity purposes in these figures, electrical wires are not illustrated, but are conventional in the art and would be easily accomplished by persons skilled in the art.

Figure 1:
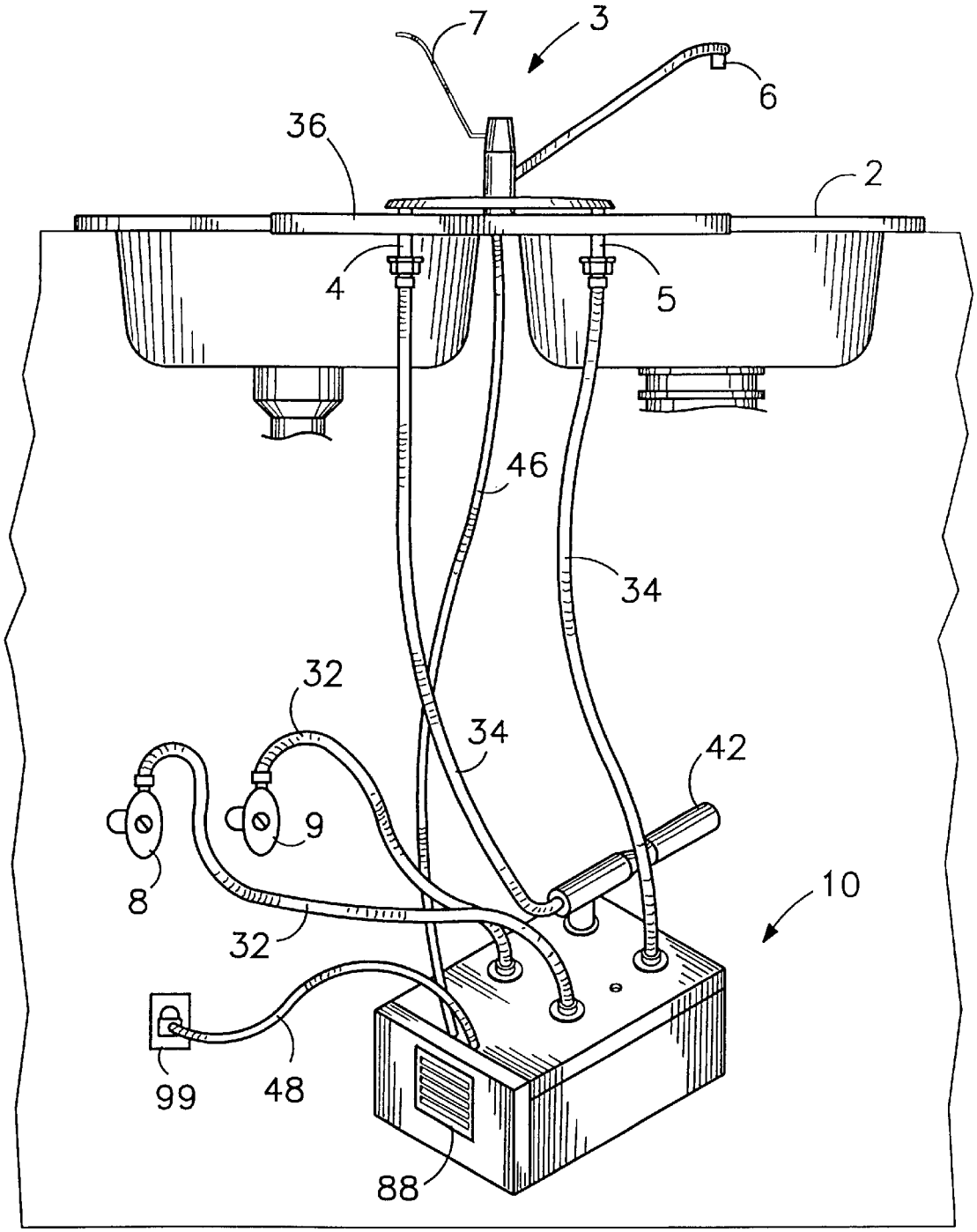
FIG. 1 is an illustrative view of the present invention handless or footless operation of an electrical automatic water control apparatus installed underneath a typical sink.

Referring to FIG. 1, there is shown at 10 a handless or footless operation of the present invention electrical automatic water flow control apparatus which is installed underneath a sink 2, including a faucet 3, hot water inlet tube 4, a cold water inlet tube 5, a discharge spout 6 and a faucet lever 7 for manually controlling water temperature and water through the discharge spout 6. The water flow control apparatus 10 can be used in residential or commercial buildings. The water flow control apparatus 10 is installed in-line between hot and cold water shutoff valves 8 and 9, and the hot and cold water inlet tubes 4 and 5 that descend from the faucet 3. The water flow control apparatus 10 is provided with a power cord 48 which is plugged into an electrical wall outlet 99 to power the unit.

Figure 2:
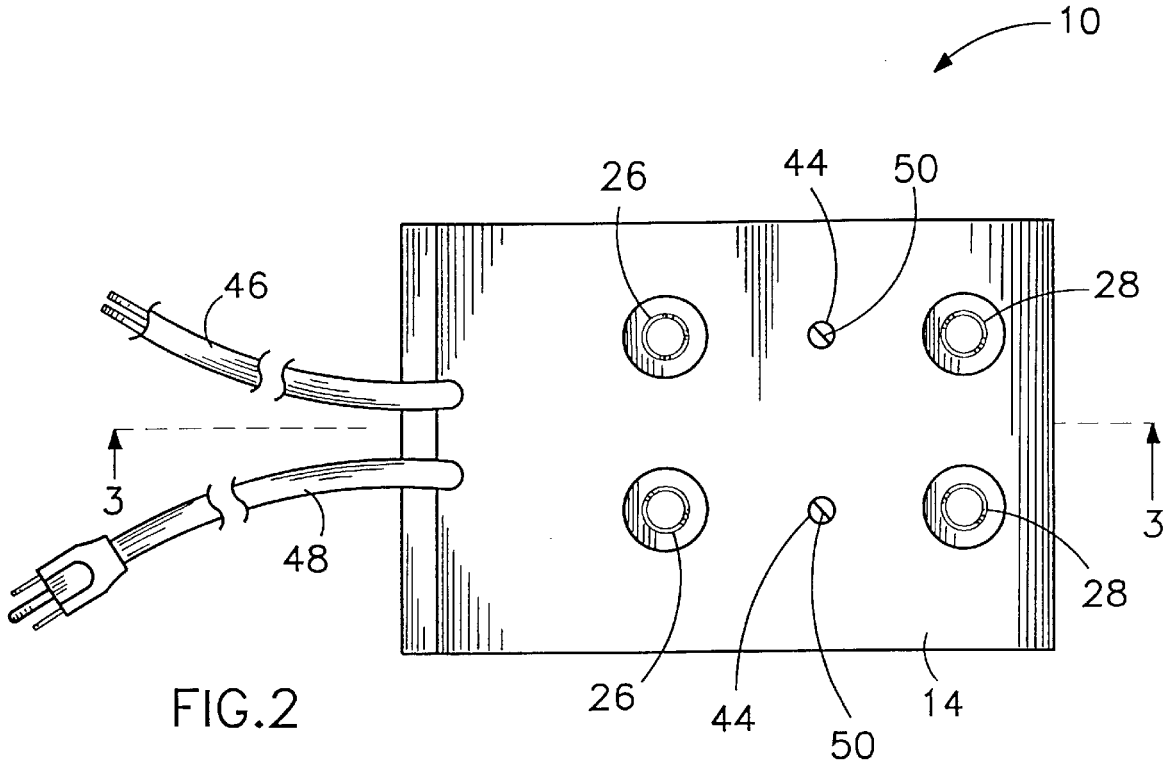
FIG. 2 is a top plan view of the present invention electrical automatic water flow control apparatus.

Referring to FIG. 2, a generally rectangular shaped housing 12 is provided with the apparatus 10 and has a top cover 14 which is attached to the top of the housing 12 to cover the enclosure. The housing 12 and cover 14 may be made of metal, molded plastic material or any other suitable material known to one skilled in the art.

Figure 3:
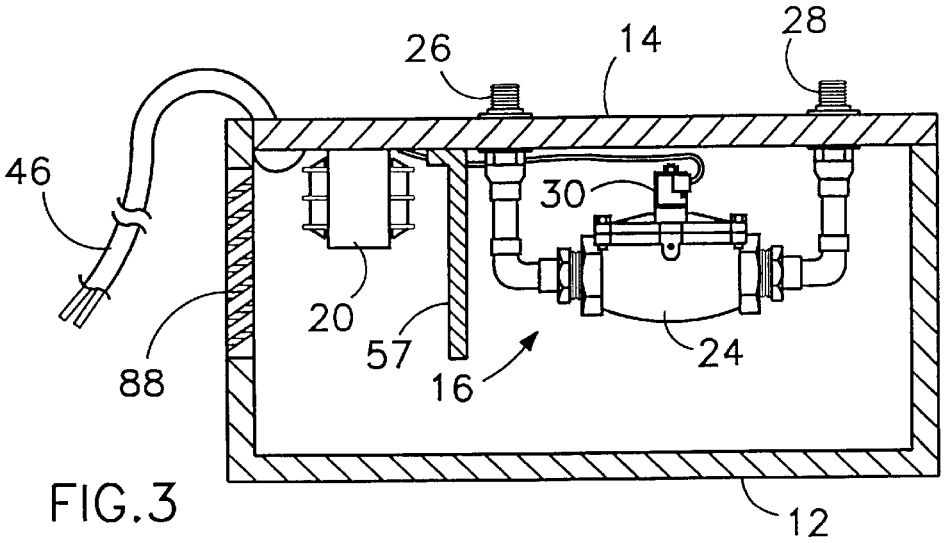
FIG. 3 is a cross-sectional view taken along line 3—3 of FIG. 2.
Figure 4:
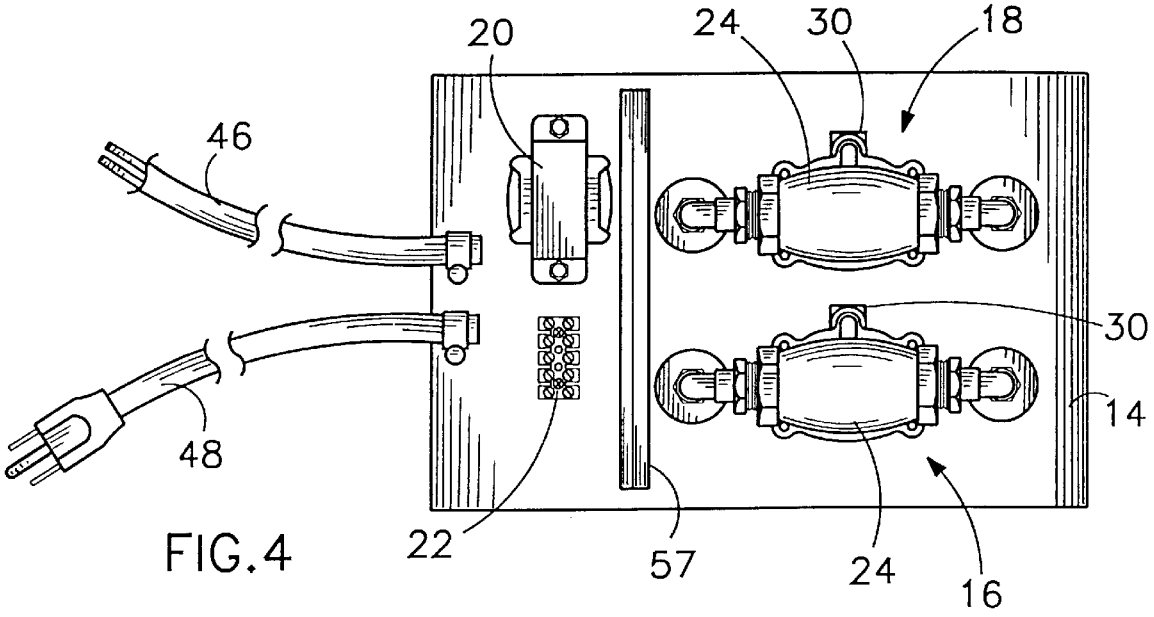
FIG. 4 is a bottom plan view of the present invention electrical automatic water flow control apparatus without the housing, showing the two solenoid operated valves.

Referring to FIGS. 2, 3 and 4, the water flow control apparatus 10 comprises a pair of solenoid operated valves 16 and 18, a transformer 20 and a distribution terminal block 22. There is provided a baffle or barrier 57 that extends the full interior width of the housing 12 and also extends downwardly approximately ⅔ of the height of the housing 12. The baffle 57 is attached to the underneath surface of the top cover 14 by conventional means and separates the transformer 20 and the terminal block 22 from the solenoid operated valves 16 and 18. The baffle 57 prevents water from electrically shorting out the transformer 20 or the terminal block 22 should a leak in the valves occur when the water flow control apparatus 10 is in operation. The solenoid operated valves 16 and 18 start and stop the flow of hot and cold water through the flow control apparatus 10. Both solenoid operated valves 16 and 18 are installed and housed within the housing 12 and located parallel to each other. Each of the solenoid operated valves 16 and 18 has a valve body 24 and a solenoid 30 for opening and closing the valve body 24. The valve body 24 has an inlet port 26 and an outlet port 28, where both the ports 26 and 28 extend upwardly through the top cover 14 and protrude outside of the housing 12 and are secured thereto by conventional means so that they can be accessed from the exterior of the housing 12.

Each of the solenoid operated valves 16 and 18 has a flow rate adjuster 50 which is a screw tap for adjusting the water flow through the valve bodies 24 and is adjustable through apertures 44 provided on the top cover 14 of the housing 12.

There is also provided a louver vent 88 which may be formed or attached to one of the walls of the housing 12 by conventional means. The louver vent 88 will be located adjacent to the transformer 20 so that the heat generated by the transformer 20 can be vented out from the housing 12.

Referring to FIGS. 1 through 4, the inlet and outlet ports 26 and 28 have outer threads. The inlet ports 26 of the first and second solenoid operated valves 16 and 18 are respectively connected to the hot and cold water shutoff valves 8 and 9 by stainless steel jacketed flexible hoses 32 that have compression nuts on each end. The outlet ports 28 of the first and second solenoid operated valves 16 and 18 are respectively connected to the hot and cold water inlet tubes 4 and 5 of the faucet 3 by stainless steel jacketed flexible hoses 34 that have compression nuts on each end.

Figure 5:
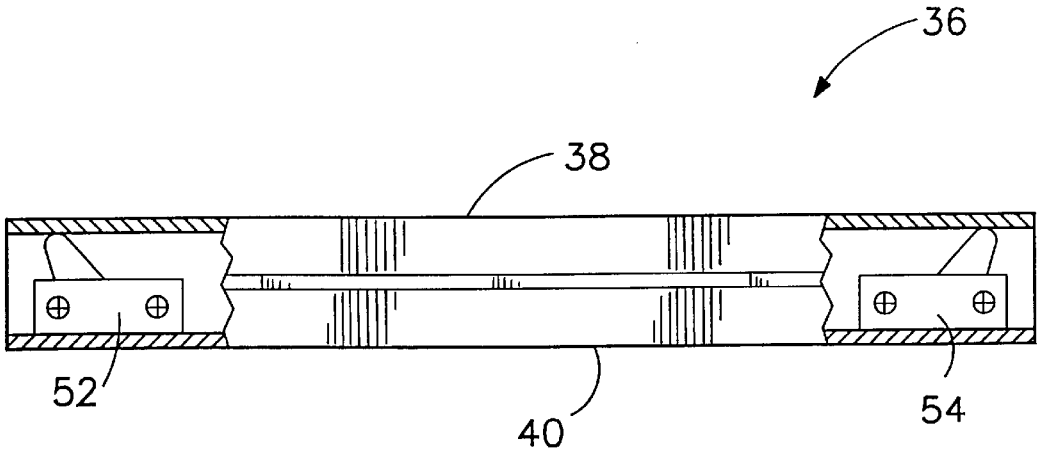
FIG. 5 is a side elevational view of a housing of an elongated bar switch actuator of the present invention electrical automatic water flow control apparatus with the end portions thereof broken away to better illustrate the components forming a part of the elongated bar switch actuator.

Referring to FIG. 5, there is shown at 36 an elongated bar switch actuator which includes a top half housing 38 and a bottom half housing 40. By way of example, the bar switch actuator 36 may include lengths of 12 inches, 16 inches or 24 inches. At least two small switches 52 and 54 are provided and housed between the top and bottom halves 38 and 40 of the bar switch actuator 36. These switches 52 and 54 may include micro-switches, magnetic switches or any other suitable switches. Preferably, micro-switches are used with the bar switch actuator 36. The two switches 52 and 54 are electrically connected to each other and located at opposite ends of the bar switch actuator 36.

Referring to FIGS. 1, 3, 4, 5 and 6, the switches 52 and 54 are further electrically connected to electrical wires 46 from the water flow control apparatus 10. These switches 52 and 54 are conventional in the art and can be activated by any body part of a user by depressing on the bar switch actuator 36 which in turn depresses either one or both of the switches 52 and 54 to be activated for electrically operating the solenoid operated valves 16 and 18. When either one of the switches 52 and 54 are activated, the first and second solenoid valves 16 and 18 are open, which allow the flow of water from the shutoff valves 8 and 9 through the water flow control apparatus 10 and through the discharge spout 6. When the switches 52 and 54 are deactivated, the first and second solenoid operated valves 16 and 18 are closed, which stops the flow of water through the water flow control apparatus 10.

There may be provided conventional water hammer arresters 42 which are used in conjunction with the present invention electrical water flow control apparatus 10 (only one water hammer arrester is shown in FIG. 1). The water hammer arrester 42 is respectively connected to the outlet ports 28 of the first and second solenoid operated valves 16 and 18 for protecting the water flow control apparatus 10 from the water hammer or knots.

Figure 6:
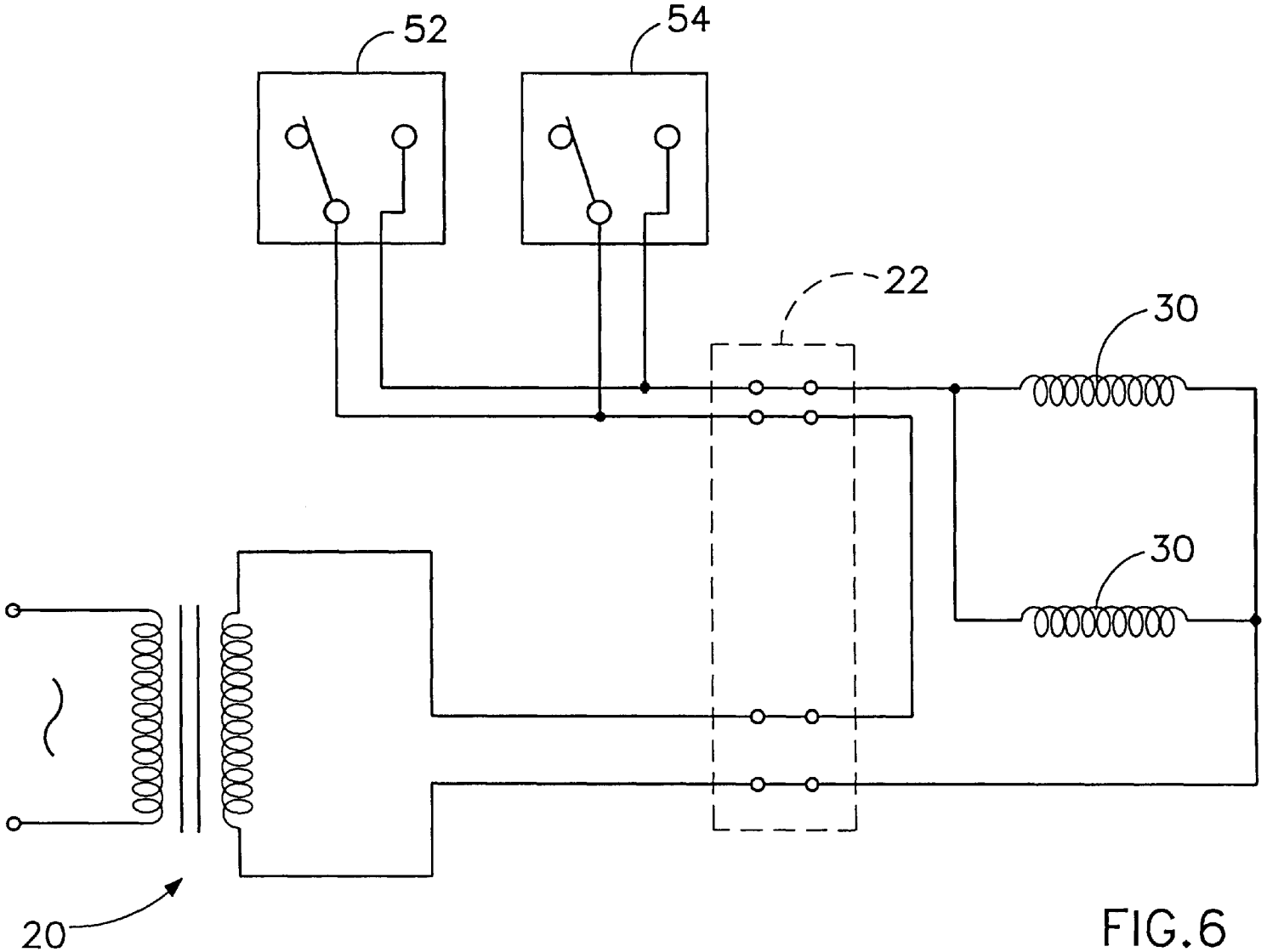
FIG. 6 is a preferred circuit diagram of the present invention electrical automatic water flow control apparatus.

Referring to FIG. 6, there is shown a preferred circuit diagram of the present invention electrical automatic water flow control apparatus 10 which is powered by AC power. The transformer 20 reduces the 110V AC to 24V to supply current to operate the solenoids 30 of the first and second solenoid operated valves 16 and 18.

Figure 7:
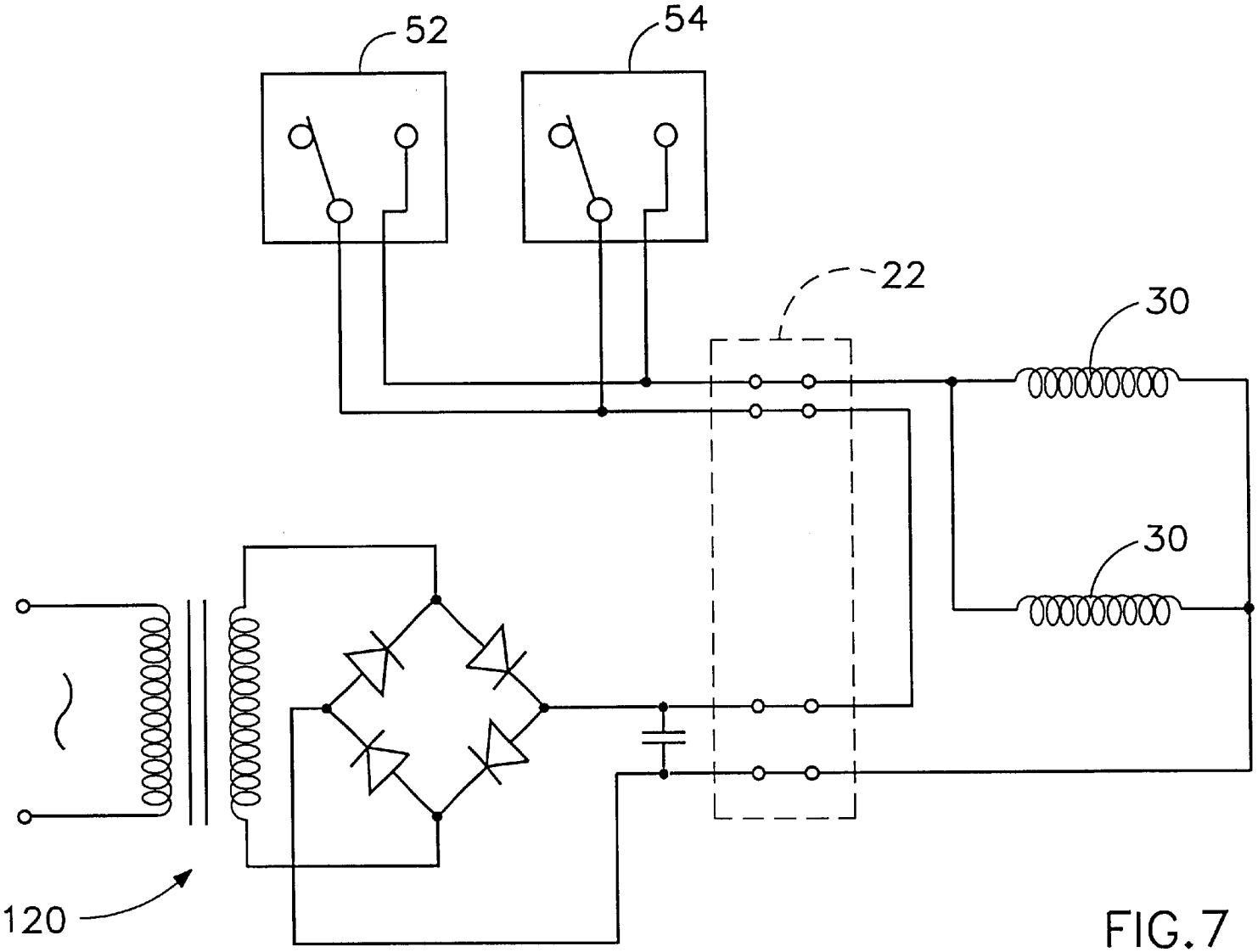
FIG. 7 is an alternative circuit diagram of the present invention electrical automatic water flow control apparatus.

Referring to FIG. 7, there is shown an alternative circuit diagram of the present invention electrical automatic water flow control apparatus utilizing a full wave bridge rectifier circuit 120.

Referring to FIGS. 1 through 6, the operation of the foregoing embodiment will now be described. The faucet lever 7 is left in the open condition and preset to a predetermined water temperature and when a user activates or pushes the bar switch actuator 36 which in turn activates the two micro-switches 52 and 54, then the first and second solenoid operated valves 16 and 18 open to allow the flow of water therethrough. When the bar switch actuator 36 is deactivated or not depressed which in turn deactivates the micro-switches 16 and 18, the first and second solenoid operated valves 16 and 18 close to stop the flow of water through the water flow control apparatus 10.

One of the unique features of the present invention is that there are no obstructions to impede cleaning the floors, and also nothing protruding out the floor level to cause accidents or potential injuries.

Another feature of the present invention allows a user to bypass the water flow control apparatus 10 without damaging the system. The user simply removes the ends of the inlet and outlet hoses 32 and 34 at the apparatus 10 and connects them together with a short ½ inch nipple (not shown), and then the apparatus 10 can be removed for repair and still provide normal operation at the sink.

The present invention conforms to conventional forms of manufacture or any other conventional way known to one skilled in the art, and is of simple construction and is easy to use.

Figure 8:
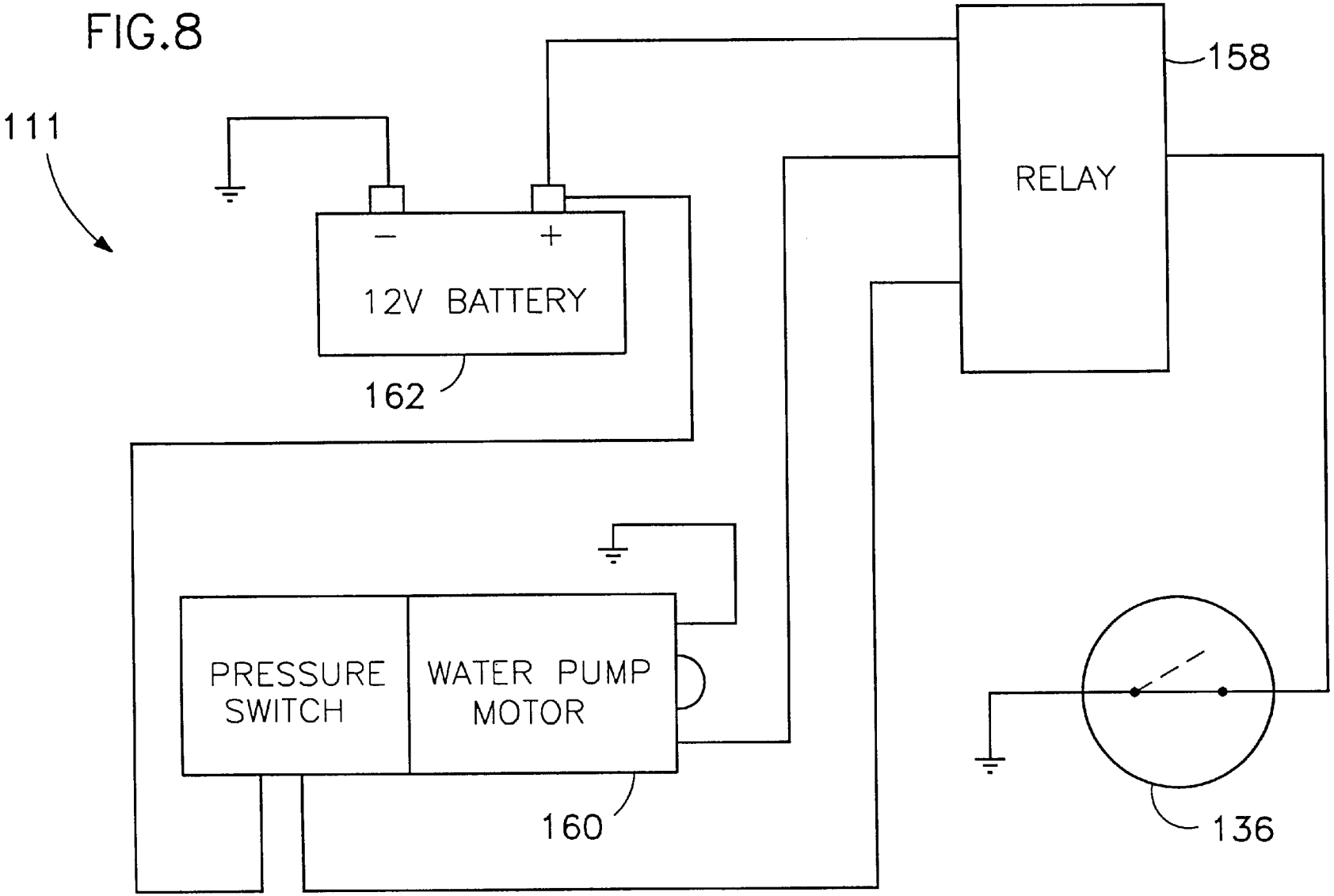
FIG. 8 is a simplified system circuit diagram of a recreational vehicle used with the present invention bar switch actuator.

Referring to FIG. 8, there is shown at 111 a simplified system circuit diagram of a recreational vehicle (RV) or other like vehicles which include marine vehicles. A power relay 158 is provided with the circuit diagram 111 and boosts the power to a water pump motor 160 which is supplied by a battery 162 of the RV so that the pump motor 160 receives a full 12V DC power, rather then the normal 9.6V to 11V supplied by the battery when the RV is not running. The relay 158 is preferably a power booster relay which is a single throw relay and is an off-the-shelf component. An elongated bar switch actuator 136 is used in the RV for conserving water and energy, to reduce the waste of water, and also to eliminate the waste of water. The elongated bar switch actuator 136 is installed in-line with the system circuit diagram 111 and is similar to the preceding embodiment of the bar switch actuator 36 shown in FIG. 5, and the description thereof will not be repeated.

The system circuit 111 is always in a closed condition, which supplies power through the system until the bar switch actuator 136 is depressed, whereby the actuator 136 opens the circuit, thereby cutting power to the water pump motor 160 which stops the pump motor 160 from running thus stopping the water flow from the fresh water holding tanks to a water discharge spout in the RV. When the bar switch actuator 136 is not depressed or released, the circuit is in a closed condition, and thereby allows the flow of water through the RV, such that the water pump motor 160 is activated. The electrical wires used in the system wiring are either 12 gage or 16 gage wires.

Defined in detail, the present invention is a liquid flow control apparatus for controlling the flow of water through a faucet having hot water inlet means, cold water inlet means, a discharge spout and a faucet lever for manually controlling water temperature and water through the discharge spout, the apparatus comprising: (a) a housing; (b) a first solenoid operated valve which starts and stops the flow of hot water through the flow control apparatus and housed within the housing, the first solenoid operated valve having an inlet port and an outlet port, the inlet and outlet ports protruding through a wall of the housing; (c) a second solenoid operated valve which starts and stops the flow of cold water through the flow control apparatus and housed within the housing and parallel to the first solenoid operated valve, the second solenoid operated valve having an inlet port and an outlet port, the inlet and outlet ports protruding through the wall of the housing; (d) means for respectively connecting the inlet ports of the first and second solenoid operated valves to hot and cold water supply means; (e) means for respectively connecting the outlet ports of the first and second solenoid operated valves to the hot and cold water inlet means of the faucet; (f) at least two micro-switches electrically connected together and housed at opposite ends of an elongated bar switch actuator, the bar switch actuator having a top half housing and a bottom half housing, where the top half housing is depressible by a body part of a user which in turn activates either one of the at least two micro-switches for electrically operating the first and second solenoid operated valves to an open condition, which allow the flow of water therethrough, and when the first and second solenoid valves are deactivated, the first and second solenoid operated valves are in a closed condition which stop the flow of water therethrough; and (g) a transformer for providing current to operate the first and second solenoid operated valves; (h) whereby the faucet lever is in an open condition and preset to a predetermined water temperature such that when the user depresses on the bar switch actuator which in turn activates either one of the at least two micro-switches which in turn activates the first and second solenoid operated valves to the open condition to allow water flow therethrough, and when the bar switch actuator is not depressed, the at least two micro-switches are deactivated which in turn deactivate the first and second solenoid operated valves to the closed condition to stop water flow therethrough.

Defined broadly, the present invention is a liquid flow control apparatus for controlling the flow of water through a faucet having hot water inlet means, cold water inlet means, a discharge spout and a faucet lever for manually controlling water temperature and water through the discharge spout, the apparatus comprising (a) a housing; (b) first and second solenoid valves which start and stop to allow the flow of water through the flow control apparatus and housed within the housing and parallel to each other, each solenoid valve having an inlet port and an outlet port, the inlet and outlet ports protruding through a wall of the housing; (c) means for respectively connecting the inlet ports of the first and second solenoid valves to hot and cold water supply means; (d) means for respectively connecting the outlet ports of the first and second solenoid valves to the hot and cold water inlet means of the faucet; (e) at least two actuating means electrically connected together and housed within an elongated bar switch actuator including a top half housing and a bottom half housing, where the top half housing is depressible by a body part of a user which in turn activates either one of the at least two actuating means for electrically operating the first and second solenoid to an open condition, which allow the flow of water therethrough, and when the first and second solenoid valves are deactivated, the first and second solenoid valves are in a closed condition which stop the flow of water therethrough; and (f) power supply for providing current to operate the first and second solenoid operated valves; (g) whereby the faucet lever is in an open condition and preset to a predetermined water temperature such that when the user depresses on the bar switch actuator which activates either one of the at least two actuating means which in turn activates the first and second solenoid valves to the open condition to allow water flow therethrough, and when the bar switch actuator is not depressed, the at least two actuating means are deactivated which in turn deactivate the first and second solenoid valves to the closed condition to stop water flow therethrough.

Defined more broadly, the present invention is a fluid flow control apparatus for controlling the flow of water through a faucet having hot water inlet means, cold water inlet means, a discharge spout and a faucet lever for manually controlling water temperature and water through the discharge spout, the apparatus comprising: (a) a pair of solenoid valves which start and stop the flow of hot and cold water through the flow control apparatus, each solenoid valve having an inlet port and an outlet port; (b) means for respectively connecting the inlet ports of the pair of solenoid valves to hot and cold water supply means; (c) means for respectively connecting the outlet ports of the pair of solenoid valves to the hot and cold water inlet means of the faucet; (d) an elongated bar switch actuator depressible by a body part of a user for operating the pair of solenoid valves to an open condition, which allow the flow of water therethrough, and when the bar switch actuator is not depressed, the pair of solenoid valves are deactivated and in a closed condition which stop the flow of water therethrough; and (e) power supply for providing current to operate the pair of solenoid valves; (f) whereby the faucet lever is in an open condition and preset to a predetermined water temperature such that when the user depresses the bar switch actuator which in turn activates the pair of solenoid valves to the open condition to allow water flow therethrough, and when the bar switch actuator is not depressed, which deactivates the pair of solenoid valves to the closed condition to stop water flow therethrough.

Defined alternatively in detail, the present invention is a bar switch actuator used in conjunction with an electrical system of a recreational vehicle (RV) or the like, the RV having a 12V battery and a water pump motor electrically connected to the battery for pumping water out from fresh water holding tanks, the bar switch actuator comprising: (a) an elongated top half housing and an elongated bottom half housing adjoined together to form the bar switch actuator; (b) at least one micro-switch housed within the top and bottom halves, where the top half housing is depressible by a body part of a user which in turn deactivates the at least one micro-switch for cutting power to the water pump motor and stops the flow of water though the RV; and the fresh water holding tanks, and when the top half housing is not depressed or released, power is restored to the water pump motor, and thereby allows the flow of water through the RV; and (c) a power booster relay electrically connected to the 12V battery, the water pump motor and the at least one micro-switch for providing a full 12V DC from the 12V battery to the water pump motor; (d) whereby when the bar switch actuator is depressed which in turn depresses the at least one micro-switch for cutting power to the water pump motor and stops the flow of water therethrough, and when the bar switch actuator is not depressed which in turn releases the at least one micro-switch, and thereby provides power to the water pump motor and starts the water flow therethrough.

Defined alternatively broadly, the present invention is a bar switch actuator used in conjunction with an electrical system of a recreational vehicle (RV) or the like, the RV having a 12V battery and a water pump motor for pumping water out from fresh water holding tanks, the bar switch actuator comprising: (a) a top half and a bottom half adjoined together to form the bar switch actuator; and (b) at least one switch housed within the top and bottom halves, where the top half is depressible by a body part of a user which in turn deactivates the at least one switch for cutting power to the water pump motor and stops the flow of water therethrough from the fresh water holding tanks, and when the top half is not depressed or released, power is restored to the water pump motor, and thereby allows the flow of water through the RV; (c) whereby when the bar switch actuator is depressed which in turn depresses the at least one switch for cutting power to the water pump motor and stops the flow of water therethrough, and when the bar switch actuator is not depressed which in turn releases the at least one switch, and thereby provides power to the water pump motor and starts the water flow therethrough.

Defined alternatively more broadly, the present invention is a bar switch actuator used in conjunction with an electrical system of a recreational vehicle (RV) or the like, the RV having a 12V battery and a water pump motor for pumping water out from fresh water holding tanks, the bar switch actuator comprising: at least one actuating means housed within the bar switch actuator and depressible by a body part of a user which in turn deactivates the at least one actuating means for cutting power to the water pump motor and stops the flow of water therethrough from the fresh water holding tanks, and when the at least one actuating means is not depressed so that it is released, power is restored to the water pump motor, and thereby allows the flow of water through the RV; whereby when the bar switch actuator is depressed which in turn deactivates the at least one actuating means for cutting power to the water pump motor and stops the flow of water therethrough, and when the bar switch actuator is not depressed which in turn activates the at least one actuating means, and thereby provides power to the water pump motor and starts the water flow therethrough.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

The present invention has been described in considerable detail in order to comply with the patent laws by providing full public disclosure of at least one of its forms. However, such detailed description is not intended in any way to limit the broad features or principles of the present invention, or the scope of the patent to be granted. Therefore, the invention is to be limited only by the scope of the appended claims.

What is claimed is:

1. A bar switch actuator used in conjunction with an electrical system of a recreational vehicle (RV) or the like, the RV having a 12V battery and a water pump motor electrically connected to the battery for pumping water out from fresh water holding tanks, the bar switch actuator comprising:

a. an elongated top half housing and an elongated bottom half housing adjoined together to form said bar switch actuator;

b. at least one micro-switch housed within said top and bottom halves, where the top half housing is depressible by a body part of a user which in turn deactivates the at least one micro-switch for cutting power to said water pump motor and stops the flow of water therethrough from the fresh water holding tanks, and when the top half housing is not depressed or released, power is restored to said water pump motor, and thereby allows the flow of water through the RV; and c. a power booster relay electrically connected to said 12V battery, said water pump motor and said at least one micro-switch for providing a full 12V DC from said 12V battery to said water pump motor;

d. whereby when said bar switch actuator is depressed which in turn depresses said at least one micro-switch for cutting power to said water pump motor and stops the flow of water therethrough, and when said bar switch actuator is not depressed which in turn releases said at least one micro-switch, and thereby provides power to said water pump motor and starts the water flow therethrough.

2. A bar switch actuator used in conjunction with an electrical system of a recreational vehicle (RV) or the like, the RV having a 12V battery and a water pump motor for pumping water out from fresh water holding tanks, the bar switch actuator comprising:

a. a top half and a bottom half adjoined together to form said bar switch actuator;

b. at least one switch housed within said top and bottom halves, where the top half is depressible by a body part of a user which in turn deactivates the at least one switch for cutting power to said water pump motor and stops the flow of water therethrough from the fresh water holding tanks, and when the top half is not depressed or released, power is restored to said water pump motor, and thereby allows the flow of water through the RV; and c. a power booster means for electrically connecting to said 12V battery, said water pump motor and said at least one switch for providing a full 12V DC from said 12V battery to said water pump motor;

d. whereby when said bar switch actuator is depressed which in turn depresses said at least one switch for cutting power to said water pump motor and stops the flow of water therethrough, and when said bar switch actuator is not depressed which in turn releases said at least one switch, and thereby provides power to said water pump motor and starts the water flow therethrough.

3. The bar switch actuator in accordance with claim 2, wherein said power booster means is a single throw relay.

4. The bar switch actuator in accordance with claim 2, wherein said at least one switch includes a micro-switch.

5. The bar switch actuator in accordance with claim 2, wherein said at least one switch includes a magnetic switch.

6. A bar switch actuator used in conjunction with an electrical system of a recreational vehicle (RV) or the like, the RV having a 12V battery and a water pump motor for pumping water out from fresh water holding tanks, the bar switch actuator comprising:

a. at least one actuating means housed within said bar switch actuator and depressible by a body part of a user which in turn deactivates the at least one actuating means for cutting power to said water pump motor and stops the flow of water therethrough from the fresh water holding tanks, and when the at least one actuating means is not depressed so that it is released, power is restored to said water pump motor, and thereby allows the flow of water through the RV; and b. a power booster means electrically connected to said 12V battery, said water pump motor and said at least one actuating means for providing a full 12V DC from said 12V battery to said water pump motor;

c. whereby when said bar switch actuator is depressed which in turn deactivates said at least one actuating means for cutting power to said water pump motor and stops the flow of water therethrough, and when said bar switch actuator is not depressed which in turn activates said at least one actuating means, and thereby provides power to said water pump motor and starts the water flow therethrough.

7. The bar switch actuator in accordance with claim 6, wherein said power booster means is a single throw relay.

8. The bar switch actuator in accordance with claim 6, wherein said at least one actuating means includes a micro-switch.

9. The bar switch actuator in accordance with claim 6, wherein said at least one switch includes a magnetic switch.

* * * * *